US010072451B2

(12) United States Patent
Carrier

(10) Patent No.: US 10,072,451 B2
(45) Date of Patent: Sep. 11, 2018

(54) WINDOW OPERATOR

(71) Applicant: Christian Carrier, L'Ancienne-Lorette (CA)

(72) Inventor: Christian Carrier, L'Ancienne-Lorette (CA)

( * ) Notice: Subject to any disclaimer, the term of this patent is extended or adjusted under 35 U.S.C. 154(b) by 0 days.

(21) Appl. No.: 14/545,896

(22) Filed: Jul. 2, 2015

(65) Prior Publication Data

US 2017/0002594 A1 Jan. 5, 2017

(51) Int. Cl.
*E05F 11/16* (2006.01)
*E05F 11/10* (2006.01)

(52) U.S. Cl.
CPC ..... *E05F 11/16* (2013.01); *E05F 11/10* (2013.01); *E05Y 2201/716* (2013.01); *E05Y 2900/148* (2013.01)

(58) Field of Classification Search
CPC ..... E05F 11/16; E05F 11/10; E05Y 2201/716; E05Y 2900/148
USPC ..... 49/246, 248, 249
See application file for complete search history.

(56) References Cited

U.S. PATENT DOCUMENTS

| | | | | |
|---|---|---|---|---|
| 6,672,010 | B1 * | 1/2004 | Gledhill | E05F 11/34 49/339 |
| 7,140,825 | B2 * | 11/2006 | Takahashi | F16B 25/0021 408/222 |
| 8,141,295 | B2 * | 3/2012 | Carrier | E05F 11/16 49/246 |
| 8,776,437 | B2 * | 7/2014 | Bourgoin | E05F 11/10 16/429 |
| 9,003,706 | B2 * | 4/2015 | Meves | E05B 65/0025 49/246 |
| 2010/0071266 | A1 * | 3/2010 | Archambault | E05F 11/16 49/327 |
| 2010/0101148 | A1 * | 4/2010 | Carrier | E05F 11/16 49/346 |

* cited by examiner

*Primary Examiner* — Gregory J Strimbu
(74) *Attorney, Agent, or Firm* — Eric Fincham

(57) ABSTRACT

An operator for a window comprising a base and a cover, the base being attached to a window sash with an aperture extending through the base, an arm having first and second ends with a first end secured to the base, the first end of the arm having an aperture therein overlying the aperture in the base and an upper securement member extending at least partially through the aperture in the first end of the arm, the upper securement member having a threaded recess therein, a lower securement member screwthreadedly engaged with the upper securement member and extending through the base in an abutting relationship thereto, the cover engaging with the upper securement member to prevent rotation thereof when the lower securement member is screwthreadedly engaged with the upper securement member.

4 Claims, 6 Drawing Sheets

WINDOW OPERATOR

FIELD OF THE INVENTION

The present invention relates to windows, and more particularly, relates to improvements in window operators such as may be used in a casement type window.

BACKGROUND OF THE INVENTION

A casement window has a window sash which is movably mounted within a frame by a pair of hinges mounted between the window frame and the top and bottom of the window sash. Normally, the arrangement is one in which there is a track which is mounted on the window frame and a sash arm is connectable to the window sash. The support arm interconnects the track and the sash window; the support arm is pivotably connected to the sash arm and to the track. The sash arm is pivotably connected to a mounting shoe which is supported and guided for movement lengthwise of the track.

It is also well known in the art to provide an intervening link between the sash arm and the movable shoe to provide for an offset sash arm. Such an arrangement typically includes a second intervening length between the support arm and the movable shoe to provide further support.

Casement window operators typically include a hand crank which drives a worm gear arrangement. In turn, the worm gear arrangement is connected to an arm or lever which pushes the window sash open. The worm gear assembly typically includes a gear shaft having the worm at one end thereof with the other end of the gear shaft extending outwardly through the housing to engage a crank. When the crank is turned, the worm causes the worm wheel to rotate and this in turn causes the sash to pivot on its hinges between open and closed positions.

There are several different arrangements for casement windows. A first arrangement utilizes a single arm operator which has an arm which pivots about an axis that is fixed with respect to the window frame and worm gear. The remote end of the arm carries a bearing which slides in a track mounted to the underside of the sash. One disadvantage with such a single end operator is the torque required to move the sash towards its fully open position.

An improvement on the single arm operator is the split arm variety. A split arm operator includes a second end which has a pivot point in the middle of the second arm and a remote end of the second arm is secured to a pivotable mounting to a fixed point on the sash. While the split arm operator allows the window to extend to its fully open position, it does present some difficulty at the time of the initial opening of the sash.

A further type of window operator is a dual arm operator which has one arm which rotates around a fixed axis and a housing which carries at its far end a bearing to slide in the track mounted to the window sash. This arrangement includes a second arm which has a pivot joint and which is secured at its remote end by a pivotable but fixed connection to the sash.

One of the problems associated with the above operators is an eventual loosening of the attachments within the housing due to the torque generated by the worm gear.

SUMMARY OF THE INVENTION

It is an object of the present invention to provide an operator which overcomes some of the disadvantages of the prior art.

According to one aspect of the present invention, there is provided an operator for a window comprising a base and a cover, the base having means for attachment to a window sash, an aperture extending through the base, an arm having first and second ends, the first end being secured to the base, the first arm having an aperture therein overlying the aperture and the base, an upper securement member extending at least partially through the aperture in the first end of the arm, the securement member having a threaded recess therein, a lower securement member screwthreadedly engaged with the upper securement member and extending through the base in an abutting relationship thereto, the cover engaging with the upper securement member to prevent rotation of the upper securement member when the lower securement member is screwthreadedly engaged therewith.

The operators used with casement windows is hinged on the side between the top and bottom of the window sash. The operator of the present invention may be utilized with a single arm, split arm or dual arm arrangement.

The operator preferably uses a worm wheel formed at a first end of an arm and which worm wheel is designed to engage a worm formed at one end of the shaft. The arrangement is such that the arm is secured to the base by upper and lower securement members which are screwthreadedly engaged with each other. In this regard, the top securement member has a recess formed therein which is designed to receive the lower securement member. This arrangement allows the arm to be "drawn down" as the screw (bolt) is tightened.

The arrangement also uses a top securement member which is designed to engage another portion of the housing and preferably the cover to prevent rotation thereof. This allows the screw to be retightened if it becomes loose during service.

DETAILED DESCRIPTION OF THE INVENTION

Figure 1:
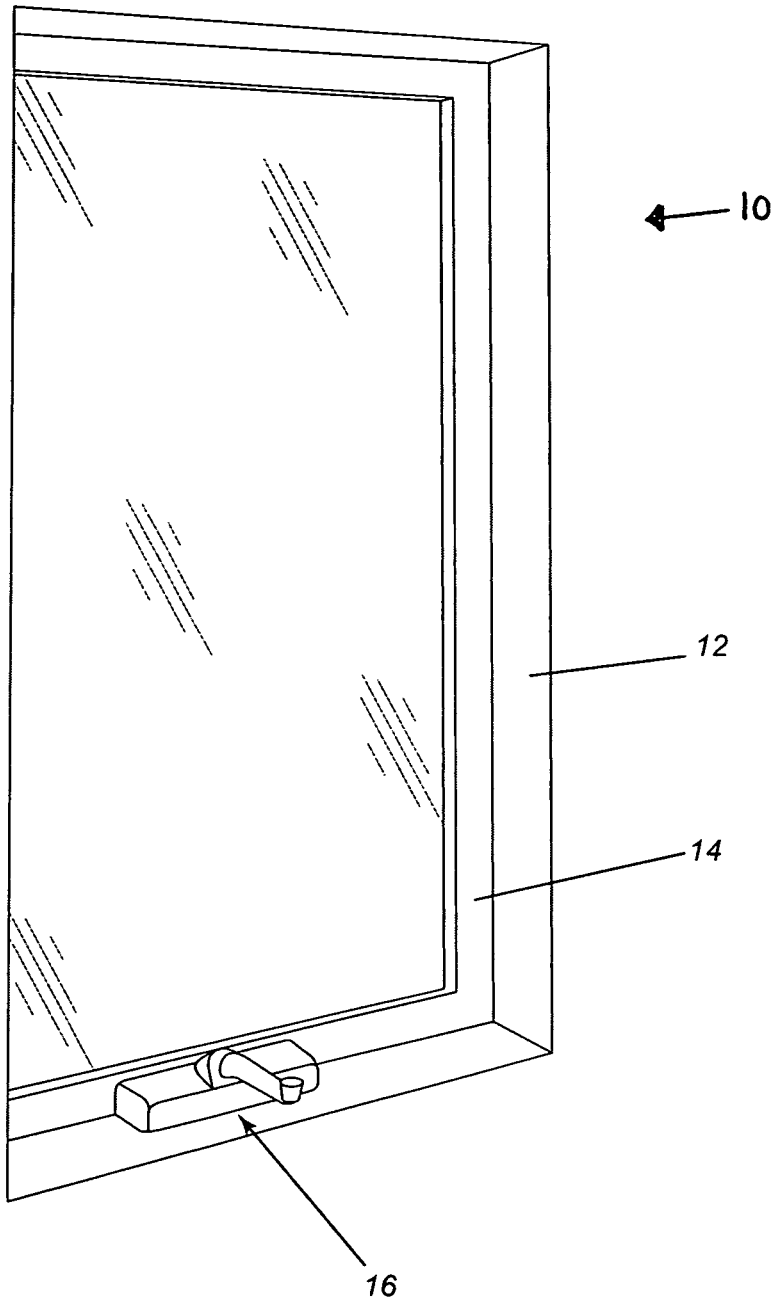
FIG. 1 is a perspective view of a window assembly utilizing the operator of the present invention.

Referring to the drawings in greater detail and by reference characters thereto, there is illustrated in FIG. 1 a window generally designated by reference numeral 10 and which window 10 includes a window frame 12 and a sash 14. An operator 16 is utilized to open and close a window which is of the casement type.

Figure 2A:
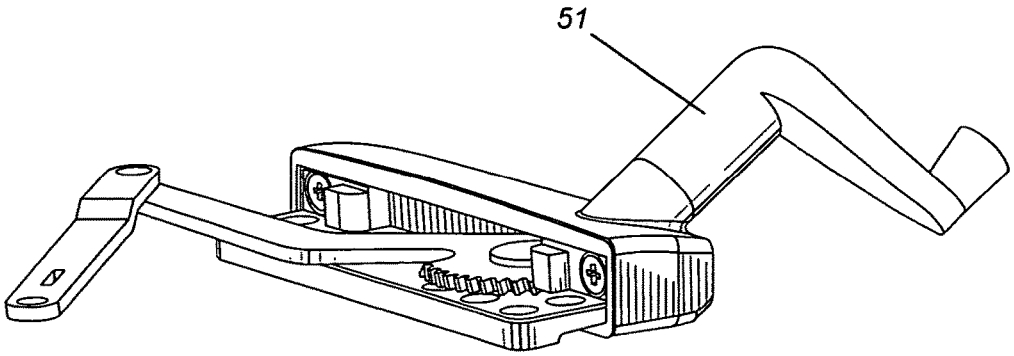
FIG. 2*a* is a perspective view of the window operator.
Figure 2B:
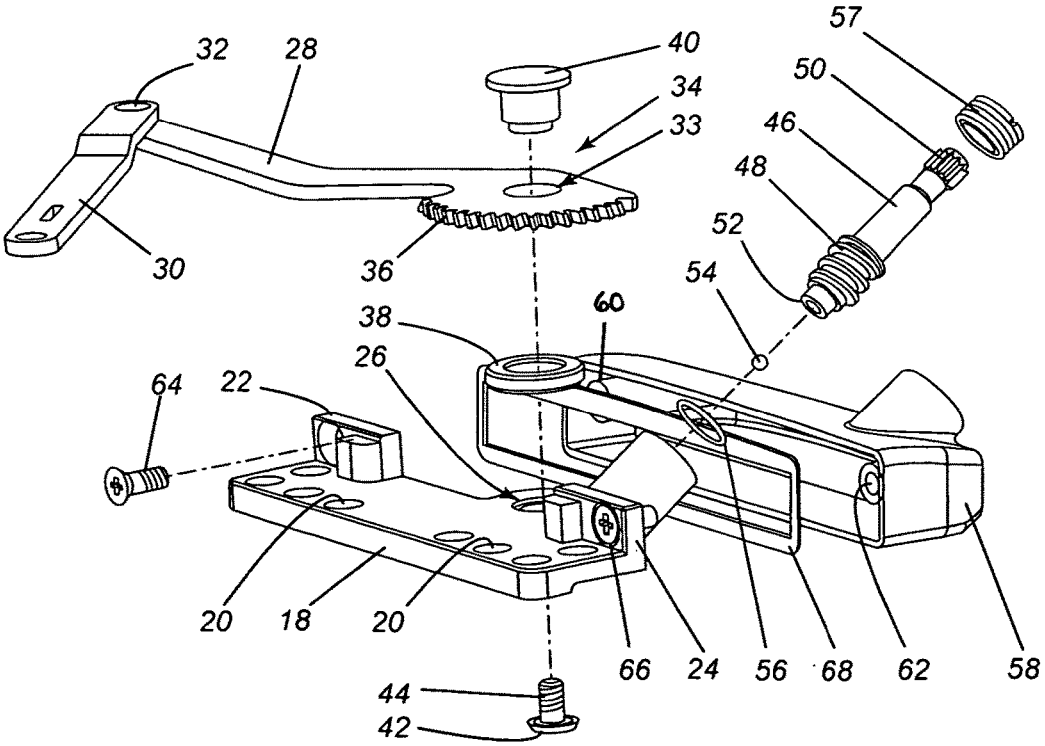
FIG. 2*b* is an exploded view thereof.

Operator 16, as may be better seen in FIGS. 2*a* and 2*b*, includes a base 18 which has a plurality of mounting apertures 20. As is conventional, base 18 may be secured to the window frame by screws or other suitable mechanical fasteners.

Mounted on the upper side of base 18 are posts 22 and 24 for reasons which will become apparent hereinbelow. Base 18 also has an aperture 26.

In the illustrated embodiment, operator 16 includes a first arm 28 and a second arm 30. Arms 28 and 30 are conventional in the art of window operators. Arms 28 and 30 are secured by rivet 32.

Arm 28 has a first end generally designated by reference numeral 34 and forms a portion of a worm wheel 36, as is well known in the art. It will be noted that there is provided an aperture 33 in worm wheel 36 and which aperture 33 overlies aperture 26. A shim 38 is placed between worm wheel 36 and base 18.

An upper securement member 40 works in conjunction with a lower securement member 42 to secure arm 28 in position. In this regard, upper securement member 40 has a threaded recess which is designed to screwthreadedly engage with threads 44 on lower securement member 42. In this arrangement, the lower securement member 42, upon tightening the same, draws upper securement member 40 downwardly into position to maintain a secure connection therebetween.

A shaft 46 has a worm 48 formed at one end thereof. At the opposed end, there is provided a spur gear 50 and worm screw 57 which is designed to engage with a handle 51.

Shaft 46, at the end proximate worm 48, has a recess 52 which is designed to receive a ball bearing 54 to allow for easy turning of shaft 46. A thermal seal 56 is also provided to prevent the passage of air from the interior of operator 16.

Operator 16 also includes a monocoque housing 58 which has two internally threaded cylinders 60, 62 which are designed to receive screws 64, 66 passing through post 22 and 24 to thereby mount the base 18 to the monocoque housing 58.

Ideally, a sealing member 68 is provided for thermal sealing against sash 14.

Figure 3A:
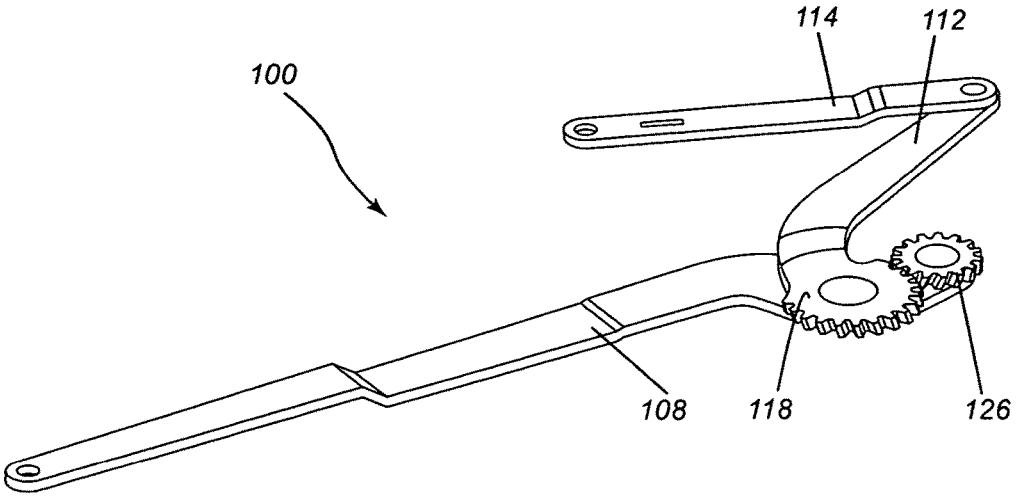
FIG. 3*a* is a perspective view of a portion of the operator utilized with a double arm arrangement.
Figure 3B:
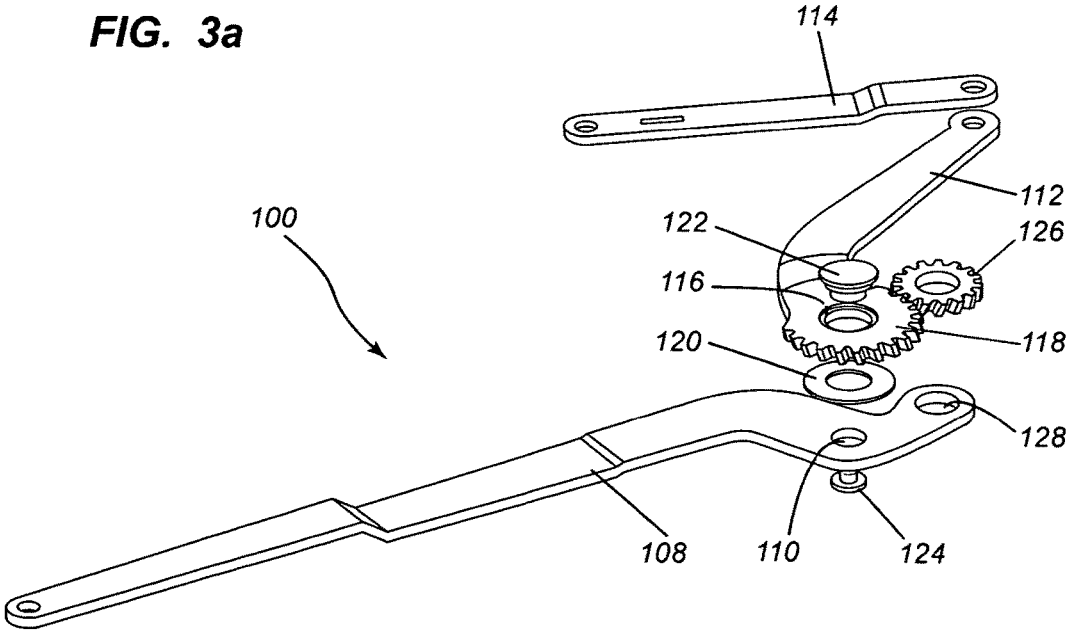
FIG. 3*b* is an exploded view thereof.
Figure 4:
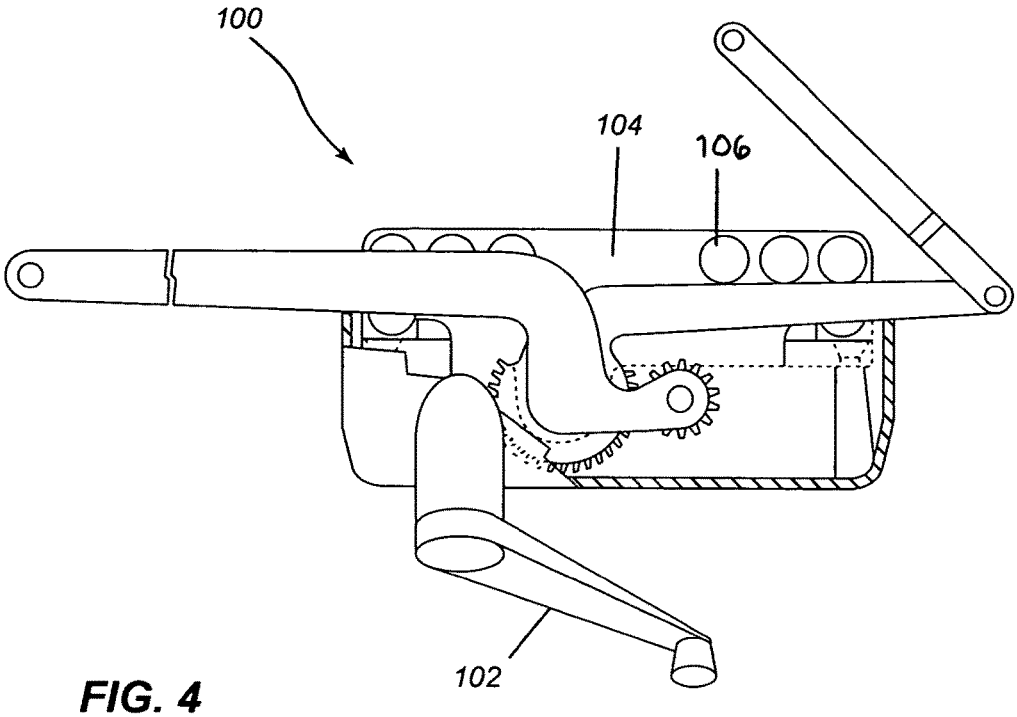
FIG. 4 is a top plan view of the operator of FIGS. 3*a* and 3*b*.
Figure 5:
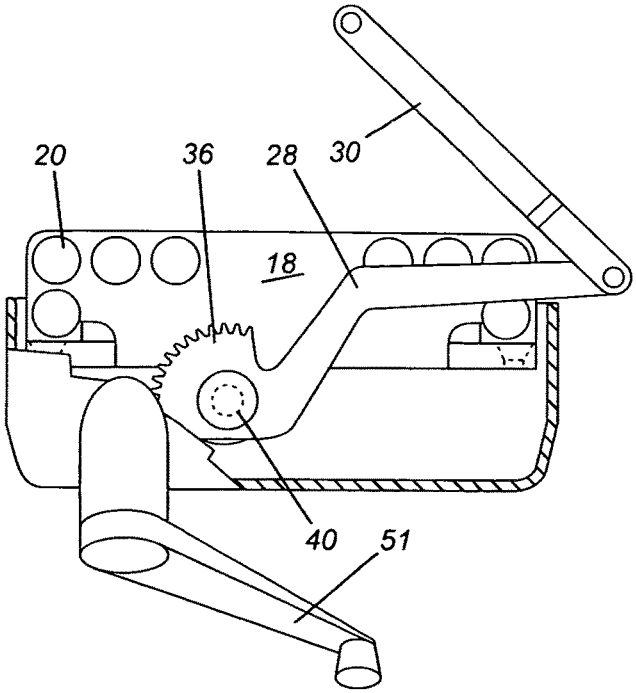
FIG. 5 is a top plan view of the operator of FIGS. 2*a* and 2*b*.

Turning to the embodiment of FIGS. 3*a*, 3*b* and 4, there is illustrated a double arm operator and which double arm operator is generally designated by reference numeral 100. Double arm operator 100 includes a handle 102 and a base 104 which has a plurality of mounting apertures 106.

A first arm 108 includes a mounting aperture 110 formed therein. A second arm 112 has a second arm extension 114 as in the previously described embodiment. A mounting aperture 116 is formed in the center of worm wheel 118. A shim 120 is mounted between second arm 112 and first arm 108. As in the previously described embodiment, there is provided an upper securement member 122 and a lower securement member 124 which are screwthreadedly engaged with each other.

In this embodiment, there is provided a second worm wheel 126 while as may be seen in FIG. 3B, there is provided an aperture 128 for mounting of worm wheel 126. In this regard, it may be mounted in the same manner as previously described with use of upper and lower securement members.

As may be seen in FIG. 4, the worm drives worm wheel 118 which in turn will drive a worm gear in a conventional manner.

Figure 6:
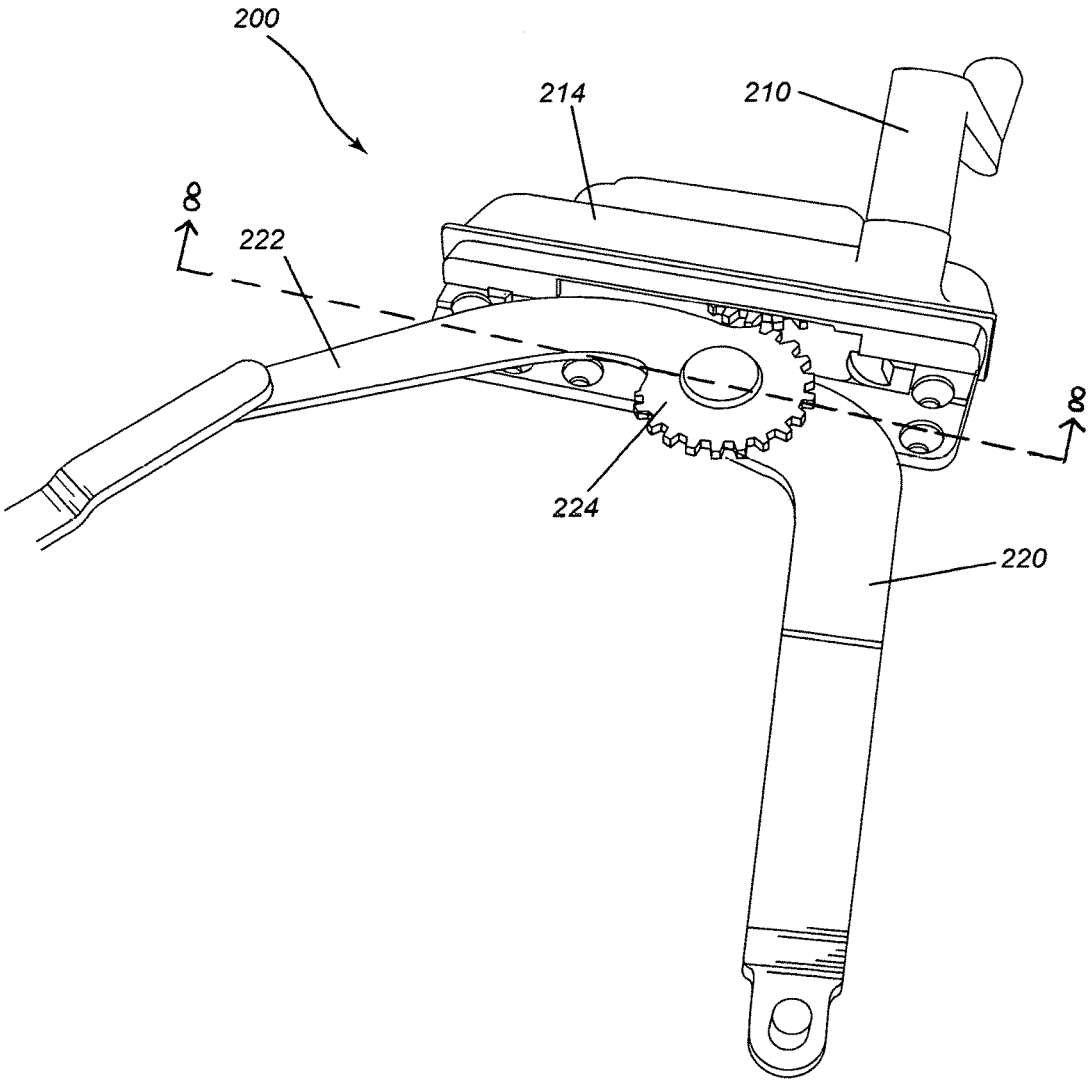
FIG. 6 is a perspective view of a further embodiment of an operator according to the present invention.
Figure 7:
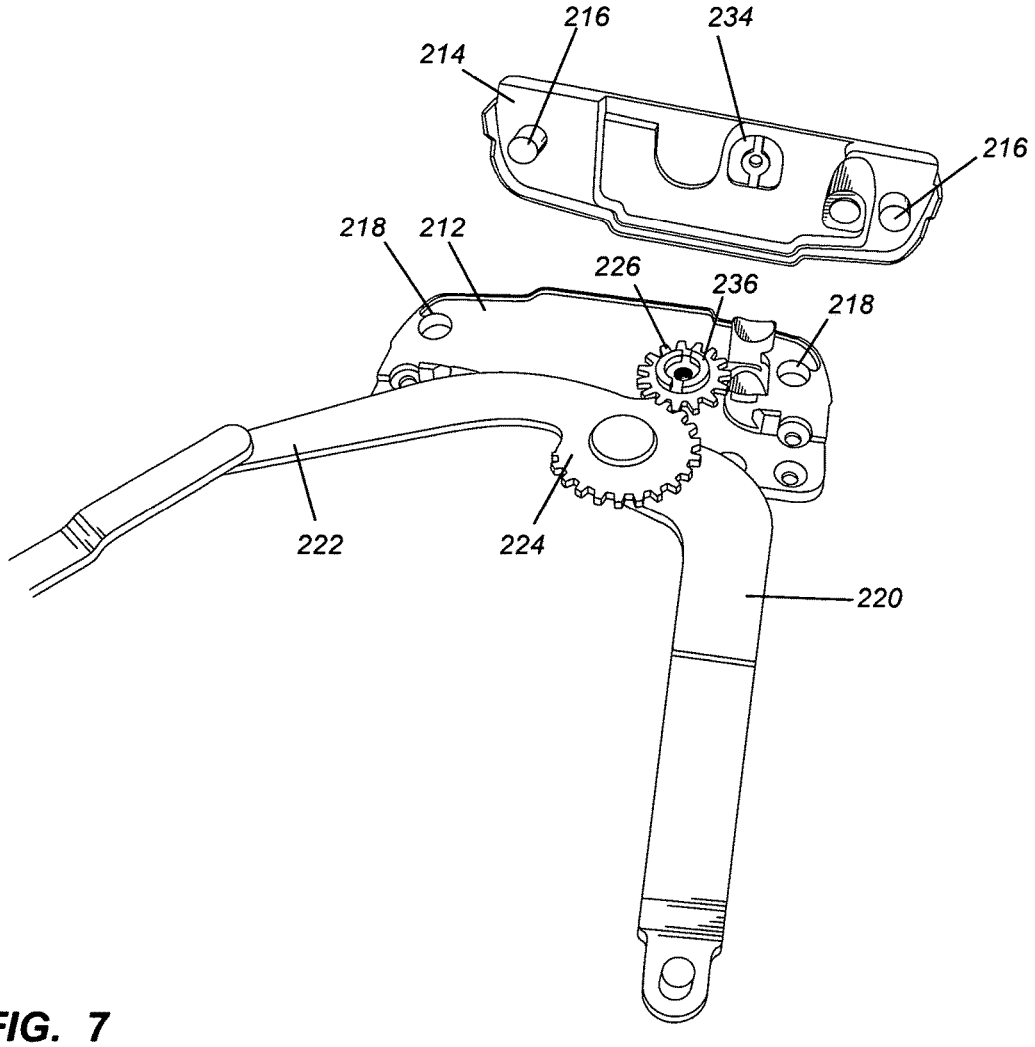
FIG. 7 is an exploded view thereof.
Figure 8:
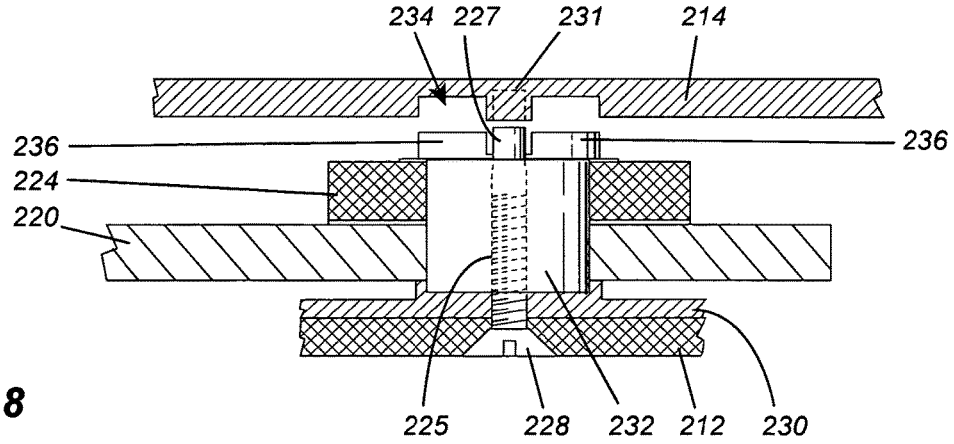
FIG. 8 is a cross-sectional view thereof.

Referring to the embodiment of FIGS. 6 to 8, operator 200 includes a handle 210. A housing is made up of base plate 212 and a cover 214. Projections 216 formed on the underside of cover 214 will mate with corresponding recesses 218. The operator includes a first arm 220 and a second arm 222. The operator also includes a first worm wheel 224 and a second worm wheel 226 as described in the previous embodiment.

For securing the operator, a bolt 228 having a lower threaded portion 225 and an upper non-threaded portion 227 engages with an upper securement member 232 by means of threaded area 225. A shim 230 is also utilized. A shim 230 is also utilized.

Non-threaded portion 227 of bolt 228 fits within a recess 231 while protrusions 236 fit within recess 234. Thus, the cover engages with upper securement member 232 to prevent rotation of the same.

This arrangement is advantageous in that, over time, the loosening of bolt 228 frequently occurs due to multiple openings and closings. This arrangement permits retightening of the bolt 228 and upper securement member 232.

It will be understood that the above described embodiments are for purposes of illustration only and that changes and modifications may be made thereto without departing from the spirit and scope of the invention.

I claim:

1. An operator for a window comprising:

a base and a cover, an aperture extending through said base, an arm having first and second ends, said first end being secured to said base, said first end of said arm having an aperture therein overlying said aperture in said base, an upper securement member extending at least partially through said aperture in said first end of said arm, said upper securement member having a threaded recess therein, a lower securement member having a lower threaded portion and an upper non-threaded portion, said lower threaded portion being screwthreadedly engaged with said threaded recess in said upper securement member and extending through said base in an abutting relationship thereto, said upper non-threaded portion extending into recess in said cover and said cover engaging with said upper securement member to prevent rotation of said upper securement member when said lower securement member is screwthreadedly engaged therewith.

2. The operator of claim 1 wherein said first end of said arm has a worm wheel formed thereon.

3. The operator of claim 2 further including a shaft having a worm operatively connected to said worm wheel.

4. The operator of claim 3 further including a shim mounted between said upper securement member and said base.

* * * * *